US006442843B1

(12) United States Patent
Jue et al.

(10) Patent No.: US 6,442,843 B1
(45) Date of Patent: Sep. 3, 2002

(54) KNIFE AND SHEATH ASSEMBLY

(76) Inventors: Michael C. Jue, 1824 Capistrano St., Del Mar, CA (US) 92106; Alan K. Uke, 355 14th St., Del Mar, CA (US) 92014; Jeffery D. Arnett, 3362 Avocado Vista La., Fallbrook, CA (US) 92028

( * ) Notice: Subject to any disclaimer, the term of this patent is extended or adjusted under 35 U.S.C. 154(b) by 24 days.

(21) Appl. No.: 09/766,071

(22) Filed: Jan. 19, 2001

(51) Int. Cl.[7] ..... B26B 29/02

(52) U.S. Cl. ..... 30/151; 30/162; 30/335; 224/232

(58) Field of Search ..... 30/151, 162, 335, 30/161, 154, 164, 224, 232, 235, 240

(56) References Cited

U.S. PATENT DOCUMENTS

| | | | | | |
|---|---|---|---|---|---|
| 845,792 | A | * | 3/1907 | Jenkins | 30/162 |
| 3,524,570 | A | * | 8/1970 | Seguine | 224/232 |
| 4,404,747 | A | | 9/1983 | Collins | |
| 4,558,516 | A | * | 12/1985 | Collins | 224/232 |
| D303,001 | S | | 8/1989 | Su | |
| 4,964,554 | A | * | 10/1990 | Collins | 224/232 |
| 5,001,834 | A | * | 3/1991 | Collins | 30/151 |
| D317,037 | S | | 5/1991 | Koshiishi | |
| 5,067,239 | A | | 11/1991 | Collins | |
| 5,123,167 | A | * | 6/1992 | Kelley | 224/232 |
| 5,138,768 | A | * | 8/1992 | Collins | 224/232 |
| D334,791 | S | | 4/1993 | Collins | |
| 5,255,436 | A | | 10/1993 | Yoshida | |
| 5,297,341 | A | * | 3/1994 | Collins | 30/162 |
| 5,315,761 | A | * | 5/1994 | Norton et al. | 224/232 |
| 5,379,520 | A | | 1/1995 | Collins | |
| 5,647,130 | A | * | 7/1997 | Collins | 224/232 |
| 5,711,079 | A | | 1/1998 | Fischer et al. | |
| 5,794,347 | A | * | 8/1998 | Serpa | 224/232 |
| 5,915,793 | A | * | 6/1999 | Serpa | 224/232 |
| 6,138,363 | A | * | 10/2000 | Kawashima | 224/232 |

OTHER PUBLICATIONS

Dive Knives, Cutlery Shoppe Brochure, Summer 1994.

* cited by examiner

*Primary Examiner*—M. Rachuba
*Assistant Examiner*—Jason Prone
(74) *Attorney, Agent, or Firm*—Brown, Martin, Haller & McClain, LLP

(57) ABSTRACT

A knife and sheath assembly includes a knife having a handle and a blade and a sheath having a cavity for releasably receiving the knife blade in a storage condition. A first end portion of the blade is adjustably mounted in the handle and a second end portion including a cutting edge protrudes from the handle. The blade is movable between a first, retracted position in which a first length of the blade protrudes from the handle and a second, extended position in which a second length of the blade longer than the first length protrudes from the handle. A releasable latch member on the handle releasably locks the knife blade in the first and second positions, and the sheath cavity is designed to receive the portion of the knife blade which protrudes from the handle in the retracted position, such that the overall length of the assembly is reduced when the knife is sheathed.

15 Claims, 2 Drawing Sheets

KNIFE AND SHEATH ASSEMBLY

BACKGROUND OF THE INVENTION

The present invention relates to a knife and sheath assembly, and is particularly concerned with such assemblies for use underwater by divers.

Various types of knives such as sporting or utility knives are typically stored with their cutting blade within a suitable protective sheath when not in use. In some cases, the knife is held in the sheath by frictional engagement between the blade and sheath. However, such an arrangement is not suitable for underwater use, because the blade may accidentally slide out of the sheath when the diver is swimming through the water, or as the diver initially jumps into the water. Divers therefore need to have a knife and sheath arrangement in which the knife is securely held in the sheath while the diver is moving through the water, yet can be readily removed by the diver as needed.

Some prior art diver's knives incorporate mechanical locking devices to hold the knife in the sheath, and the sheath is suitably secured to the diver's belt or waistband. This type of assembly is described, for example, in U.S. Pat. Nos. 4,404,747, 5,067,239 and 5,379,520 of Collins.

SUMMARY OF THE INVENTION

It is an object of the present invention to provide a new and improved knife and sheath assembly which is particularly suitable for use by divers.

According to the present invention, a knife and sheath assembly is provided, which comprises a knife having a handle and a blade, and a sheath having a cavity for releasably receiving the blade of the knife in a storage condition, and at least one attachment device for securing the sheath to a diver, diving equipment or clothing. The knife blade has a first end portion adjustably mounted in the handle and a second end portion having a cutting edge protruding from the handle, the first end portion being movable between a first, retracted position in which a first length of the blade protrudes from the handle and a second, extended position in which a second length of the knife blade longer than the first length protrudes from the handle. The handle has a releasable latch member for releasably locking the knife blade in each of the two positions. The sheath cavity is designed for receiving the knife blade in the retracted position, such that the overall length of the assembly when in the storage condition can be reduced, and the knife blade can be readily extended when removed from the sheath for use.

In an exemplary embodiment, the same latch member is used both to secure the knife blade in the retracted position and to secure the knife in the sheath, so that a single latch release action can be used both to remove the knife from the sheath and to extend the blade into its fully extended position. A suitable biasing device such as a spring within the handle biases the knife blade from the retracted to the extended position. A non-metallic member may be positioned between an inner end of the knife blade and the spring in order to electrically insulate the metallic components from one another in order to inhibit galvanic corrosion.

The knife and sheath assembly may be selectively mountable on various different items of diver's clothing or equipment, or about the diver's forearm. The sheath in an exemplary embodiment has a through slot for receiving a belt or strap which is secured about the diver's waist, forearm, or leg, if desired, and also has threaded holes for receiving bolts or the like for securing the sheath to a bc (buoyancy compensator) or hose clamp.

In an exemplary embodiment, the knife blade has opposite side edges, and a pair of spaced notches are provided in one side edge for releasable engagement with the latch member in the retracted and extended positions. The latch member in this case has a latching edge or tang which is resiliently biased into the respective notch when the blade is moved into the extended or retracted position, and a manually engageable portion of the latch member can be pushed by the user in order to release the tang from the respective notch. The outermost notch may also have a cutting edge for providing a line cutter when the blade is extended.

The knife and sheath assembly of this invention therefore will be more compact than conventional diver's knives when the blade is stored in the sheath in the retracted position. This will make it less obtrusive to the diver when the knife is not in use. It can also be secured in any one of a number of convenient locations about the diver, the diver's clothing, or the diver's equipment.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 2:
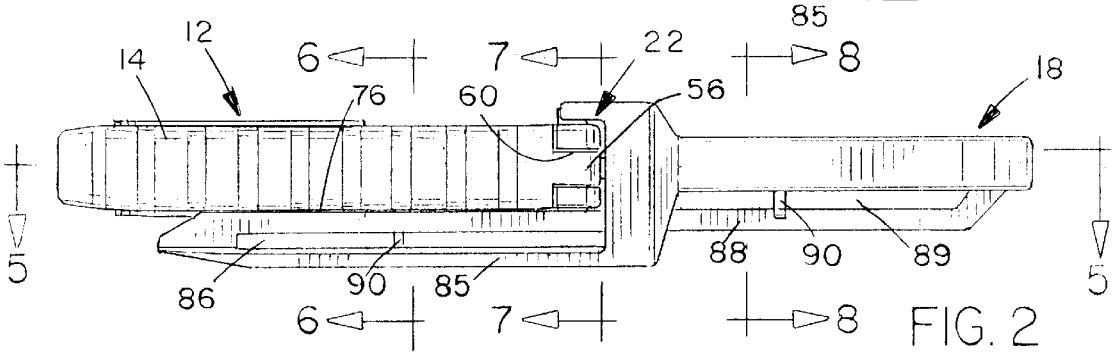
FIG. 2 is a rear view thereof.
Figure 3:
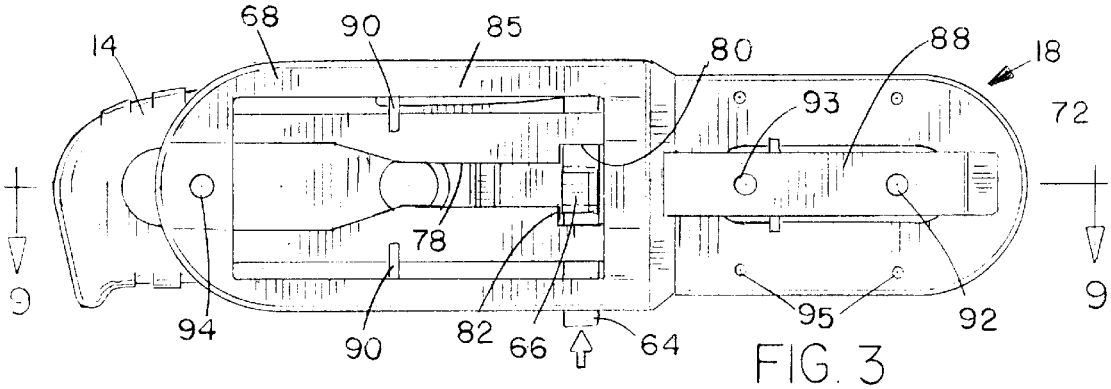
FIG. 3 is a bottom plan view.
Figure 4:
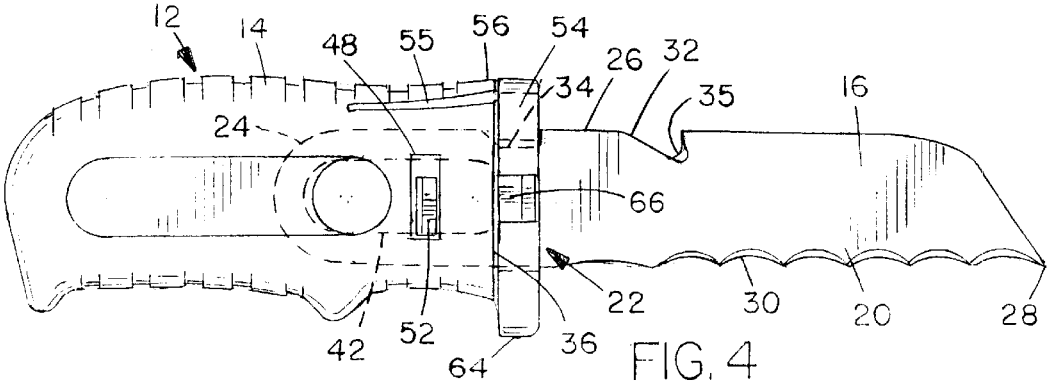
FIG. 4 is a bottom plan view of the knife with the sheath removed and the blade extended.

A knife and sheath assembly 10 according to an exemplary embodiment of the invention is illustrated in FIGS. 1 to 10 of the drawings. The assembly 10 basically comprises a knife 12 having a handle 14 and a knife blade 16, and a sheath 18 for releasably holding the knife 12 when not in use. The knife has one end mounted in the handle such that a cutting portion 20 of the knife projects from the handle, as indicated in FIG. 4.

Figure 5:
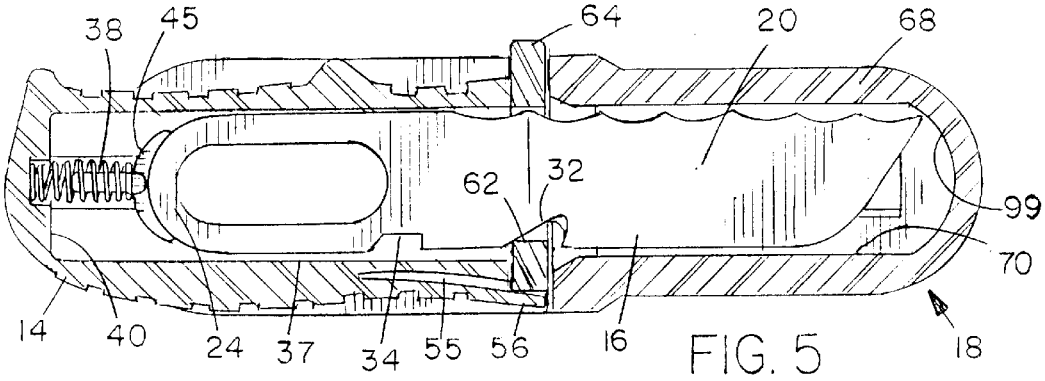
FIG. 5 is a sectional view taken on line 5—5 of FIG. 2.
Figure 6:
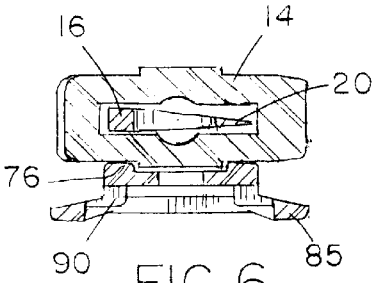
FIG. 6 is a sectional view taken on line 6—6 of FIG. 2.
Figure 7:
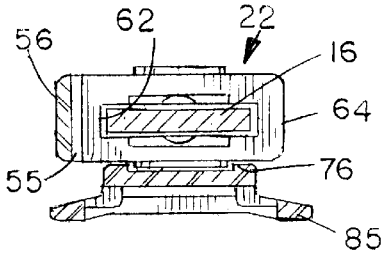
FIG. 7 is a sectional view taken on line 7—7 of FIG. 2.
Figure 9:
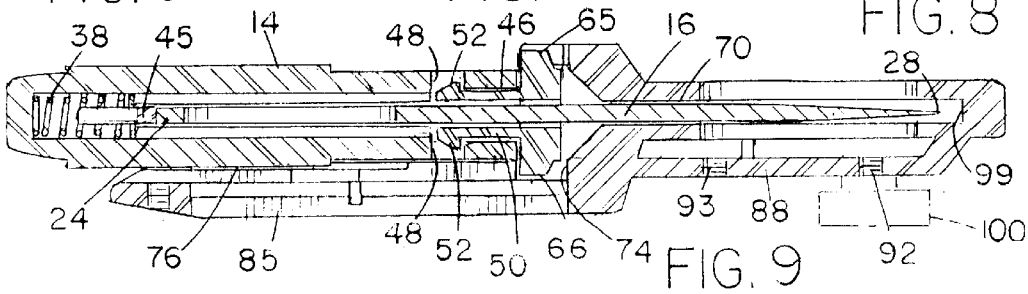
FIG. 9 is a sectional view taken on line 9—9 of FIG. 3.
Figure 10:
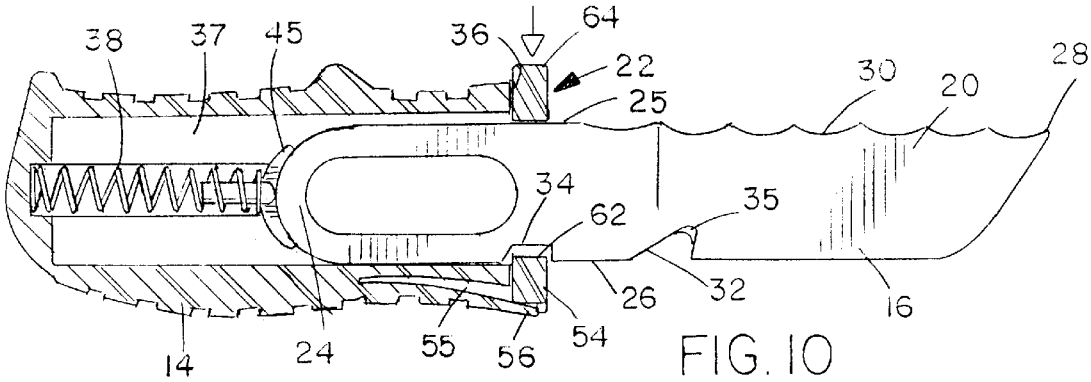
FIG. 10 is a view similar to FIG. 5 with the sheath removed and the blade latch released.

The knife blade 16 is adjustably mounted in the handle for movement between an extended position as illustrated in FIGS. 4 and 10 in which the cutting portion 20 projects out of the handle for a first distance, and a retracted position as indicated in FIG. 5 in which the cutting portion 20 is retracted partially into the handle, so that the length of the cutting portion which projects out of the handle is less than that in the extended position of FIG. 10. The knife is releasably latched in the retracted and extended position by means of a latch member 22 mounted at the forward, open end of the handle. The blade 16 is a flat, elongate member of suitable metal having a rear end 24 which is engaged within the handle 14 as indicated in FIGS. 5,9 and 10, and opposite side edges 25,26 leading up to a pointed front end 28 outside the handle. The cutting portion 20 of the blade has a serrated cutting edge 30 along the side edge 25. The opposite side edge 26 has two spaced notches 32,34 for releasable latching engagement with member 22 in the retracted and extended positions, respectively, as will be described in more detail below with reference to FIGS. 5 and 10. The outermost notch 32 also has a cutting edge 35 and additionally forms a line cutter of the type normally provided on diving knifes.

The handle 14 has an open forward end 36 and a cavity 37 extending inwardly from the forward end for receiving the rear end portion of the blade 16. A spring 38 acts between the inner end wall 40 of cavity 37 and the rear end 24 of the blade, so as to urge the blade outwardly towards the extended position. An arcuate insulating member 45 of non-conductive material is mounted between the spring 38 and rear end 24 of the blade, to avoid any metal-to-metal contact and potential corrosion as a result of such contact.

The latch member 22 is mounted at the open end of the handle and is transversely slidable in a direction transverse to the central axis of the knife blade and cavity between the operative or latching position of FIG. 5 and the released position of FIG. 10, as indicated by the arrow in FIG. 10. The member 22 has a through bore or slot 46 through which the knife blade 20 extends. The handle 14 has upper and lower aligned slots 48, and the latch member 22 has resilient fingers 50 at its inner end which have outwardly directed tabs 52 for snap engagement in the respective slots 48, as best illustrated in FIG. 9. When the blade is secured in the handle, the tabs 52 are locked in the respective slots and the latch member 22 cannot be removed from the handle. As can be seen in FIG. 3, the slots 48 are wider than the tabs 52, to allow for the desired sideways latch engaging and releasing movement of the latch member 22.

Latch member 22 has an enlarged head portion 54 which is positioned against the forward end 36 of the handle when the locking tabs 52 are engaged in slots 48. One side of the handle has an inwardly directed slit 55 adjacent one side edge to form a separate, flexible biasing finger 56, which has a front end portion which engages in an indent 60 in the enlarged head portion 54 of the latch member, as best illustrated in FIGS. 2,5 and 10. Finger 56 acts like a leaf spring urging the latch member towards the locking position of FIG. 5. The latching engagement with the respective notches 32 and 34 is provided by one side edge 62 of the opening or slot in the head portion 54 through which the blade projects. The latch member 22 is provided with an outwardly projecting actuator button 64 on the opposite side to the latching edge 62, which a user can press with a finger or thumb in the direction of the arrows in FIGS. 3 and 4 in order to release the latching edge from the respective notch 32 or 34. The head portion 54 of the latching member also has a first, upwardly projecting central tooth or tab 65 and a second, downwardly projecting central tooth 66 for engagement with interengageable portions of the sheath, as will be discussed in more detail below.

The sheath 18 is of plastic or other non-conductive material, and is a generally elongate member having a first end portion 68 with a recess or cavity 70 shaped to receive the cutting portion 20 of the knife, and a second end portion 72 projecting from the lower edge 74 of the open end of the cavity and offset below the plane of cavity 70, as best illustrated in FIGS. 2 and 9. The second end portion basically provides a generally flat support surface or ledge 76 for supporting the lower face of the handle 14 when the knife is sheathed, and has a central, axially extending guide channel or slot 78 for receiving the lower tooth 66 and releasing the latch as the knife is being inserted into the sheath. The slot 78 terminates in an enlarged, generally rectangular latching recess 80 adjacent the open end of the blade-receiving cavity 70, as best illustrated in FIG. 3. As the projecting end of the knife blade is first engaged into the cavity 70, tooth 66 will first enter the wider end at the rear of channel 78 (FIG. 3). As the tooth 66 travels to the necked down, narrower portion, the gradually tapering channel width will force the latch member 22 to move transversely in a latch releasing direction, releasing the blade automatically so that it will be retracted inwardly into the handle. As the tooth enters recess 80, it will be biased sideways by finger 56 so as to move out of alignment with channel 78 and to engage behind the side wall 82 of the latching recess, as indicated in FIG. 3. At this point, the knife is locked in the sheath and cannot be removed without depressing the actuator button 64 to move the tooth or tab 66 back into alignment with channel 78, as indicated by the arrow in FIG. 3. The latching recess is designed for releasable latching engagement with the knife to prevent accidental separation of the knife from the sheath.

Figure 1:
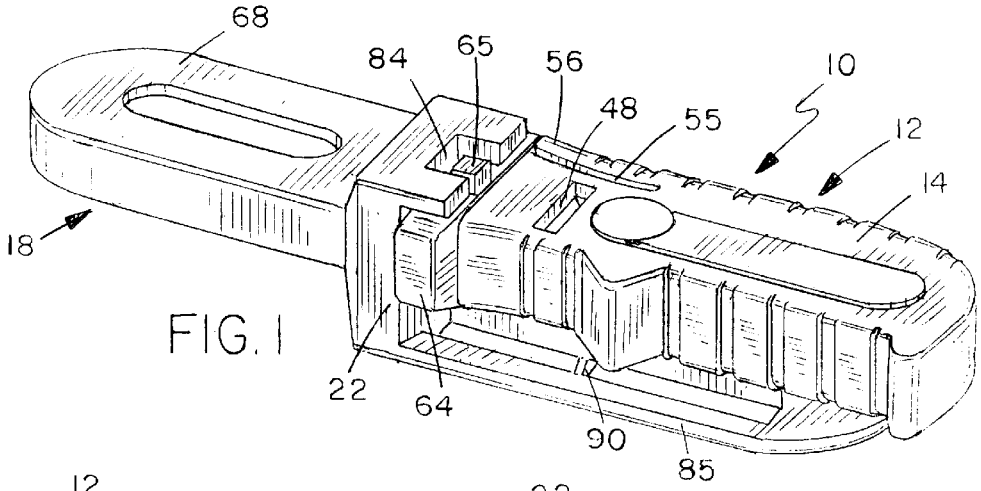
FIG. 1 is a perspective view of the sheathed knife according to an exemplary embodiment of the invention.

The open end of the first, blade-receiving end portion 68 of the sheath also has an outwardly facing upper indent or notch 84 for receiving the upper tooth 65 of the latch member when the knife is sheathed, as indicated in FIG. 1. The notch 84 is wider than tooth 65 in order to permit the necessary sideways movement of the latch member in order to release the knife from the sheath, as discussed in more detail below.

The second end portion 72 of the sheath also has a base portion 85 spaced below the support surface 76, with a transverse through slot 86 defined between the support surface 76 and base portion 85. The first end portion 68 of the sheath also has a bar or member 88 spaced below the remainder of the sheath and defining an additional transverse slot 89. The pair of slots 86,89 are designed for receiving a belt or strap for attaching the sheath to a diver's waistband, wrist, or the like. A web or wall 90 in each slot 86,89 can be removed if desired, in order to accommodate wider belts or straps.

A series of three spaced, threaded holes 92,93,94 are provided in the base portion 85 and member 88, as best illustrated in FIG. 3, for selectively attaching the sheath to items of diving equipment, particularly but not limited to a buoyancy compensator. Conventional threaded fasteners 100 may be extended through any selected pair of the holes 92,93,94 in order to attach the sheath to different types of equipment, using mounting holes conventionally provided on such devices, depending on the spacing between the bc mounting holes.

Figure 8:
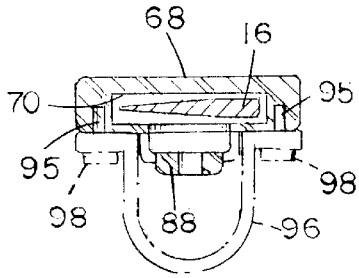
FIG. 8 is a sectional view taken on line 8—8 of FIG. 2.

Four smaller holes 95 are provided in the undersurface of the first end portion of the sheath, below the knife blade receiving cavity, for attachment to a hose clamp 96 as illustrated in dotted outline in FIG. 8. Hose clamp 96 is generally U-shaped and has a series of four holes for alignment with holes 95 in the sheath. Threaded fasteners or screws 98 secure the hose clamp 96 to the sheath, such that the knife and sheath assembly may be secured at any desired position on a diver's hose.

Thus, the sheath 18 may be easily secured at any one of a number of different locations about a diver or on the diver's equipment, as the diver prefers. In the past, diving knives have been secured either on a belt or on a bc, but have not been selectively securable in numerous different possible locations.

Operation of the knife and sheath assembly will now be described in more detail. FIGS. 4 and 10 illustrate the knife with the blade 20 in the fully extended position, separated from the sheath. In this position, the spring 38 biases the blade outwardly until the innermost side notch 34 is aligned with the latching edge 54 of the latch member 22, at which point member 22 is biased by finger 56 into latching engagement in the notch 34, as indicated in FIG. 10. When the knife is to be sheathed, the pointed end 28 of the cutting portion of the blade will first be inserted into the cavity 70 while the projecting lower tooth 66 of the latch member starts to travel along the guide channel 78. As discussed above, when the tooth 66 is guided into the narrower portion 78 of the channel, the latch member is automatically moved sideways out of notch 34, releasing the blade 20. Since the length of the cavity 70 is less than the projecting length of blade 20 in the extended position of FIG. 10, the blade must be retracted partially into the handle 14 in order to sheath the knife. The pointed end 28 of the knife blade will then engage the inner end wall 99 of cavity 70, forcing the blade inwardly into the handle and compressing spring 38, until the blade is fully concealed in the sheath, at which point the biasing finger 56 will bias the latch member back in the opposite direction until the latching edge 64 engages in notch 32, as indicated in FIG. 5. At the same time, this movement of the latching member will also cause the lower tooth 66 to move into latching engagement in recess 80. Thus, the knife is simultaneously retracted, sheathed and locked into the sheath.

When the user, such as a diver, wishes to use the knife, they simply depress button 64 again, moving the latch button 66 back into alignment with the guide channel 78 so that the knife can be withdrawn from the sheath. At the same time, the latching edge 62 is moved out of notch 32, and the spring 38 will bias the blade back out into the extended position of FIG. 10, at which point the latching edge 62 again engages the inner notch 34. This arrangement provides a more compact storage configuration which is less likely to impede the diver when moving through the water, since the knife blade is retracted when stored so that the overall length of the sheathed knife will be less than in prior art configurations having a fixed blade length projecting from the handle. At the same time, the latching and release operation is very simple, requiring only depression of a single actuator tab or button 64 in order to release the knife from the sheath and extend the knife blade. Although the latch release in the described embodiment involves depression of an actuator tab to move the latch member transversely, it will be understood that other latch release mechanisms may be used, such as a squeeze-release latch device which is released by applying inward pressure in opposite directions.

Although an exemplary embodiment of the invention has been described above by way of example only, it will be understood by those skilled in the field that modifications may be made to the disclosed embodiment without departing from the scope of the invention, which is defined by the appended claims.

We claim:

1. A knife and sheath assembly, comprising:

a knife having a handle and a blade;

a sheath having a cavity for releasably receiving the blade of the knife in a storage condition, and at least one attachment device for securing the sheath to a diver, diving equipment or clothing;

the knife blade having opposite first and second ends, a first end portion extending from the first end and adjustably mounted in the handle and a second end portion extending from the first end portion to the second end, and protruding from the handle, the first end portion being movable between a first, retracted position in which a first length of the knife blade protrudes from the handle and a second, extended position in which a second length of the knife blade longer than the first length protrudes from the handle;

the handle having a releasable latch member for releasably locking the knife blade in the first and second positions; and the sheath cavity being of predetermined length for receiving the extending second end portion of the knife blade in the retracted position.

2. The assembly as claimed in claim 1, including a biasing device in the handle for biasing the knife blade towards the extended position.

3. The assembly as claimed in claim 2, wherein the handle has a cavity having a first open end at one end of the handle and an inner closed end, the first end portion of the knife blade extending into said cavity, and the biasing device comprises a spring mounted between the inner end of the handle cavity and the first end of the knife blade.

4. The assembly as claimed in claim 3, including an insulating member of non-conductive material mounted between the spring and knife blade.

5. The assembly as claimed in claim 1, wherein the latch member and sheath include interengageable formations for releasably securing the knife in the sheath when the knife blade is in the retracted position, whereby releasing the latch member simultaneously releases the knife from the sheath and releases the knife blade for movement into the extended position.

6. The assembly as claimed in claim 1, wherein the knife blade has opposite first and second side edges, and one of the side edges has spaced first and second notches, the latch member having a latching edge for engaging the first notch in the retracted position of the knife blade and engaging the second notch in the extended position of the knife blade for releasably securing the knife blade in each position.

7. The assembly as claimed in claim 6, wherein the first notch has a cutting edge for cutting lines when the knife blade is in the extended position.

8. The assembly as claimed in claim 1, wherein the sheath comprises an elongate member having opposite first and second ends, and has a first end portion extending from the first end and having an inwardly directed cavity having an open end for receiving the knife blade, the open end of the sheath cavity facing towards the second end and having an upper edge and a lower edge, the cavity having a longitudinal axis, and a second end portion of the sheath extending from the lower edge of the open end of the cavity and offset from the cavity for supporting the handle when the knife blade is inserted in the sheath cavity.

9. The assembly as claimed in claim 8, wherein the second end portion of the sheath has a latching recess and the latch member has a latch tab for releasable latching engagement in the latching recess when the knife blade is inserted in the sheath cavity and latched in the retracted position, the latch tab being released from the latching recess when the latch member is moved in a direction to release the knife blade for movement from the retracted position.

10. The assembly as claimed in claim 1, wherein the handle has opposite first and second ends, the second end having an opening and a cavity extending inwardly from the opening, the first end portion of the knife blade extending into the cavity through the opening, and the latch member is adjustably secured across the open second end of the handle for movement between a first, latching position in which the knife blade is held in one of the retracted and extended positions and a second, released position in which the knife blade is released, the latch member having a through slot through which the knife blade extends into the handle cavity, the knife blade having opposite first and second side edges and a pair of spaced notches in one side edge, the through slot having a first end comprising means for latching engagement in an aligned notch in the knife blade in the latching position, the handle including a biasing device for biasing the latch member towards the latching position, and the latch member having an outwardly projecting actuator portion for engagement by a user to urge the latch member from the latching position to the released position.

11. The assembly as claimed in claim 10, wherein the latch member has a locking tab projecting in a direction transverse to the through slot for releasable latching engagement with the sheath when the knife blade is engaged in the sheath cavity and the latch member is in the latching position, the locking tab being released from the sheath when the latch member is moved to the released position by depressing the actuator portion.

12. The assembly as claimed in claim 11, wherein the sheath has a channel for engaging the locking tab as the knife blade enters the cavity, the channel including guide means for guiding the locking tab to move the latch member automatically in a latch releasing direction to release the knife blade for movement into the retracted position as it is fully inserted into the sheath cavity the channel having a longitudinal axis and an inner end, and an indent at the inner end extending to one side of the channel for receiving the locking tab in the latched position, whereby the biasing device in the handle biases the latch member into the latching position in latching engagement with the blade and simultaneously biases the locking tab into latching engagement with said indent when the blade is in the retracted position and fully engaged in said sheath cavity.

13. The assembly as claimed in claim 1, wherein the sheath has at least one through slot for receiving a belt or strap for securing the assembly about a selected region of a diver's body, and a plurality of threaded holes for receiving fastener members for selectively securing the sheath to an item of diving equipment.

14. The assembly as claimed in claim 13, wherein the threaded holes include a series of four holes in a rectangular arrangement for securing the sheath to a hose clamp.

15. The assembly as claimed in claim 1, wherein the first end portion of the knife blade has an elongate slot and the handle has a guide pin projecting transversely through the slot for guiding the knife blade for axial movement between the extended and retracted positions and preventing removal of the knife blade from the handle.

* * * * *